US006268704B1

(12) United States Patent
Nishizawa et al.

(10) Patent No.: US 6,268,704 B1
(45) Date of Patent: Jul. 31, 2001

(54) COLOR CATHODE RAY TUBE EQUIPPED WITH FIELD LEAK PREVENTING COATING

(75) Inventors: Masahiro Nishizawa; Norikazu Uchiyama, both of Mobara; Toshio Tojo, Ichinomiya-machi, all of (JP)

(73) Assignees: Hitachi, LTD, Tokyo; Hitachi Device Engineering Co., Ltd., Mobara, both of (JP)

( * ) Notice: Subject to any disclaimer, the term of this patent is extended or adjusted under 35 U.S.C. 154(b) by 0 days.

(21) Appl. No.: 09/022,893

(22) Filed: Feb. 12, 1998

(30) Foreign Application Priority Data

Feb. 12, 1997 (JP) ..... 9-028043

(51) Int. Cl.[7] ..... H01J 17/04; H01J 17/49

(52) U.S. Cl. ..... 315/366; 313/478; 313/479; 313/480; 315/85

(58) Field of Search ..... 315/366, 85, 364; 313/461, 466, 313, 478, 479, 480

(56) References Cited

U.S. PATENT DOCUMENTS

| | | | | |
|---|---|---|---|---|
| 2,366,687 | * | 1/1945 | Osterberg | 313/478 |
| 4,785,217 | | 11/1988 | Matsuda et al. | 313/479 |
| 5,288,558 | * | 2/1994 | Nothe | 313/478 |
| 5,550,429 | * | 8/1996 | Hayama et al. | 343/479 |
| 5,660,876 | * | 8/1997 | Kojima et al. | 427/64 |
| 5,682,077 | * | 10/1997 | Hanssen et al. | 313/478 |
| 5,686,787 | * | 11/1997 | Itou et al. | 313/478 |
| 5,770,258 | * | 6/1998 | Takizawa et al. | 427/64 |
| 5,879,217 | * | 3/1999 | Saito et al. | 445/23 |
| 5,955,831 | * | 9/1999 | Shibata et al. | 313/480 |
| 5,962,966 | * | 10/1999 | Chigusa et al. | 313/479 |
| 5,965,975 | * | 10/1999 | Chigusa et al. | 313/480 |
| 5,973,450 | | 10/1999 | Nishizawa et al. | 313/418 |

FOREIGN PATENT DOCUMENTS

| | | |
|---|---|---|
| 0533255 | 3/1993 | (EP) . |
| 0649160 | 4/1995 | (EP) . |
| 3-93136 | 4/1991 | (JP) . |
| 5-113505 | 5/1993 | (JP) . |
| 5-343008 | 12/1993 | (JP) . |
| 7-312170 | 11/1995 | (JP) . |

OTHER PUBLICATIONS

Nakajima et al., "Wet Coating for Reducing CRT Electromagnetic Wave", Feature Article I: *Future Trends of Electromagnetic Wave Shield Materials* [RE: Material], vol. 44, No. 8, pp. 68–71 (Aug. 1996) with English translation.

* cited by examiner

*Primary Examiner*—Don Wong
*Assistant Examiner*—Wilson Lee
(74) *Attorney, Agent, or Firm*—Antonelli, Terry, Stout & Kraus, LLP

(57) ABSTRACT

There is provided a field leakage preventing coating for a cathode ray tube, including a vacuum envelope having a panel section, a neck section and a funnel section connecting the panel section and the neck section; a fluorescent film applied on an inner face of the panel section; and an electron gun, mounted in the neck section, for emitting three electron beams toward the fluorescent film. The field leakage preventing coating is formed by adhering a double coating film composed of a conductive first layer mainly composed of particles of one or more kinds of metal among noble metal elements of gold (Au), silver (Ag) and platinum (Pt) and a second layer mainly composed of silicon dioxide ($SiO_2$) or magnesium fluoride ($MgF_2$) on an outer face of a faceplate of a panel section of the color cathode ray tube.

2 Claims, 11 Drawing Sheets

| | ELEF (5Hz~2kHz) | VLEF (2kHz~400kHz) |
|---|---|---|
| Embodiment 6 | 3.4V/m | 0.4V/m |
| Embodiment 7 | 7.8V/m | 0.9V/m |
| Guideline | less than 10V/m | less than 1V/m |

| | Sputtered film | NESA film | this investment |
|---|---|---|---|
| Cost | 100 | 40 | 25 |

$T = T0 \times T1$

FIG. 18

| | Transmittance of panel (T0) | Transmittance of surface treatment film (T1) | Total transmittance of panel (T) |
|---|---|---|---|
| Clear panel | 85% | 50% | 43% |
| Semi-clear panel | 76% | 50% | 38% |
| | | 60% | 46% |
| | | 66% | 50% |
| Gray panel | 69% | 62% | 43% |
| | | 67% | 46% |

FIG. 19

| | Transmittance of panel (T0) | Transmittance of prior art's surface treatment film (T1) | Total transmittance of panel (T) |
|---|---|---|---|
| tinted panel | 50% | 86~92% | 43~46% |
| dark tinted panel | 38% | 100% | 38% |

COLOR CATHODE RAY TUBE EQUIPPED WITH FIELD LEAK PREVENTING COATING

BACKGROUND OF THE INVENTION

The present invention relates to a color cathode ray tube which is equipped with an electromagnetic field leakage preventing coating, and, more particularly, to a color cathode ray tube having a field leakage preventing coating in the form of a double coating film composed of a conductive high-refractive first layer and a low-refractive second layer adhering on the surface of a faceplate of a panel section of the cathode ray tube envelope.

There is a conventional cathode ray tube in which a double coating film, composed a high-refractive first layer and a low-refractive second layer, is adhered on the outer surface of a faceplate of a panel section of the tube envelope to prevent glare on the faceplate, to prevent the accumulation of an electric charge which may produce an electrical shock when touching the faceplate and to provide an improved contrast in a displayed image produced by the cathode ray tube.

Here, the anti-reflection function of the cathode ray tube having the conventional double coating film is achieved by interference of light caused by the double coating film.

The electrical charge preventing function for preventing an electrical shock when touching the cathode ray tube having the conventional double coating film is achieved by reducing the surface sheet resistance (hereinafter abbreviated as a surface resistance) of the conductive high-refractive first layer to $10^4$ to $10^8$ Ω/□ by using a conductive high-refractive first layer, into which conductive particles, including tin oxide ($SnO_2$) and antimony oxide ($Sb_2O_3$), are combined, or into which conductive particles, including tin oxide ($SnO_2$) and indium oxide ($In_2O_3$), are combined, for example.

Further, the function for providing a high contrast in the image displayed by the cathode ray tube having the conventional double coating film is achieved by mixing a certain amount of pigment of a specific color into the high-refractive first layer of the double coating film.

As the surface treatment film formed on the outer face of the faceplate of the panel section of such a color cathode ray tube, there have been known 1) one which is obtained by forming a conductive film having a resistance of about $1\times10^3$ Ω/□ by means of sputtering, evaporation or the like to prevent electrical charge accumulation and to suppress leakage of electromagnetic waves, and by forming thereon a multi-layered film in which a low-refractive film and a high-refractive film are laminated, 2) one which is obtained by forming a NESA coating film on the outer face of the panel by means of CVD or the like as a conductive film and by laminating thereon a high-refractive film, or 3) one which is obtained by forming a conductive film by applying a solution in which particles of silver (Ag), whose specific resistance is low, are dispersed by application means, such as spin coating, and by forming thereon a low-refractive layer made of silica ($SiO_2$) by means of spin coating or the like.

It is noted that the technological features for achieving the above-mentioned functions have been disclosed in Japanese Patent Laid-Open Nos. Hei. 3-93136, Hei. 5-113505, Hei. 5-343008 and Hei. 7-312170.

In addition, there also is a known cathode ray tube which prevents an electric field generated within the cathode ray tube from leaking from the outer face of the faceplate of the panel section, i.e. a cathode ray tube having a field leakage preventing coating film, provided by adhering and forming a double coating film composed of a high-refractive first layer and a low-refractive second layer on the outer face of the faceplate of the panel section of the tube envelope and by using a conductive high-refractive first layer, in which metal particles are mixed, as the high-refractive first layer to reduce the surface resistance of the conductive high-refractive first layer to less than $1\times10^3$ Ω/□, and an example thereof is described in a magazine "Industrial Material" vol. 44, No. 9 (August, 1996) pp. 68–71.

By the way, the above-mentioned cathode ray tube having the double coating film has had a problem in that, although a conductive high-refractive first layer into which conductive particles, such as tin oxide ($SnO_2$) and antimony oxide ($Sb_2O_3$), are combined, or conductive particles, such as tin oxide ($SnO_2$) and indium oxide ($In_2O_3$), are combined, for example, is used, it has not been possible to prevent the electric field generated within the cathode ray tube from leaking to the outside through the outer face of the faceplate of the panel section on which the conductive high-refractive first layer is provided because the surface sheet resistance of the conductive high-refractive first layer is $1\times10^4$ to $10^8$ Ω/□.

The prior art cathode ray tube having the field leakage preventing coating film using particles of silver (Ag) also has had a problem in that, the film does not provide enough mechanical strength.

The prior art cathode ray tube having a field leakage preventing coating film has had another problem in that, although it allows a high contrast to be obtained by suppressing the black color of the body of the cathode ray tube, which is caused by the double coating film composed of a conductive high-refractive first layer and a low-refractive second layer, along with an increase of reflection of external light on the fluorescent screen within the faceplate from standing out due to the light absorptivity of the metal particles mixed into the conductive high-refractive first layer, the body color of the cathode ray tube is colored to a color other than black because the spectral transmittance of the mixed metal particle layer differs depending on the wavelength of the light. For instance, when the spectral transmittance of the layer of the mixed metal particles is low, such as around 420 nm in wavelength, and shows a peak of absorption, the double coating film composed of a high-refractive first layer and a low-refractive second layer turns out to have an amber color, a hue inadequate for the display.

The prior art color cathode ray tube having the structure 1) described above has had a problem in that, although it effectively prevents glare and the accumulation of an electric charge and suppresses the leakage of electromagnetic waves, its production cost is remarkably high. The color cathode ray tube having the structure 2) described above has had a problem in that it requires a number of steps for forming the NESA coat and the multi-layered film and that a desired performance cannot be fully obtained. The color cathode ray tube having the structure 3) described above has had a problem in that it is difficult to maintain the initial performance for a long period of time, though its production cost is low.

SUMMARY OF THE INVENTION

Accordingly, it is a primary object of the present invention to provide a cathode ray tube equipped with a field leakage preventing coating film which makes it possible to prevent aged deterioration of a surface sheet resistance of a conductive high-refractive first layer within a double coating film composed of a conductive high-refractive first layer and a low-refractive second layer.

It is a secondary object of the present invention to provide a cathode ray tube equipped with a field leakage preventing coating film which makes it possible to prevent the aged deterioration of the surface sheet resistance of the conductive high-refractive first layer within the double coating film, composed of a conductive high-refractive first layer and a low-refractive second layer, and to prevent the body of the cathode ray tube from being colored.

In order to achieve the first object, the inventive cathode ray tube having the field leakage preventing coating film is provided with first means in which a conductive high-refractive first layer is formed by mixing particles of one or more metals among the noble metal elements of gold (Au), silver (Ag) and platinum (Pt) to form a double coating film composed of a conductive high-refractive first layer mainly composed of the metal particles and a low-refractive second layer.

According to the first means, because the particles of one or more metals among the noble metal elements of gold (Au), silver (Ag) and platinum (Pt), which are chemically stable, are used as the metal particles of the conductive high-refractive first layer, the surface sheet resistance of the conductive high-refractive first layer may be reduced to $1\times10^3$ Ω/□ which exerts a field leakage preventing function, and, at the same time, no age deterioration of the surface sheet resistance of the conductive high-refractive first layer is caused.

Further, in order to achieve the second object, an inventive cathode ray tube having a field leakage preventing coating film is provided with second means by forming a double coating film composed of a conductive high-refractive first layer in which metal particles are mixed and a low-refractive second layer, on the outer face of the faceplate of the panel section, by forming the conductive high-refractive first layer by mixing particles of one or more metals among noble metal elements of gold (Au), silver (Ag) and platinum (Pt) and by adding a coloring matter, such as a pigment or dye, to the low-refractive second layer to exert a wavelength selective absorbing characteristic.

According to the second means, beside the fact that the conductive high-refractive first layer has a low resistance of less than $1\times10^3$ Ω/□ which produces a field leakage preventing function and that no age deterioration of the surface sheet resistance occurs similar to the first means described above, the body color of the cathode ray tube may be changed to an achromatic color by adding coloring matter which is complementary to the coloring of the body color of the cathode ray tube to the low-refractive second layer.

The color cathode ray tube of the present invention is characterized in that, in contrast to the prior art, it is provided with a low resistant conductive film formed by using a solution in which particles of chemically stable noble metals other than silver, or a noble metal mixed dispersed solution in which the ratio of silver is reduced, on the outer face of the faceplate.

The noble metals, other than silver, have a higher specific resistance than silver. Therefore, in order to obtain a desirable surface resistance, according to the present invention, the film is thickened to reduce the surface resistance and the drop of light transmittance in the visual range caused by the light absorbing characteristic intrinsic to the metal material due to the increase in the thickness is solved by using a faceplate having a high transmittance.

That is, a color cathode ray tube according to a first aspect of the invention comprises a vacuum envelope, comprising a panel section in which a fluorescent film made of at least one color of fluorescent substance is formed on the inner face thereof, a neck section in which an electron gun is mounted and a funnel section connecting the panel section and the neck section. The color cathode ray tube also has a multi-layered surface treatment film composed of a conductive high-refractive film formed on the outer face of the panel section and a low-refractive film formed thereon. The average light transmittance of the visual range in the surface treatment film is 50 to 70% and the surface resistance thereof is less than $1\times10^3$ Ω/□. By employing the construction as described above, the leakage of electromagnetic waves may be fully suppressed and the anti-reflection and electric charge preventing functions may be fully achieved.

A color cathode ray tube according to a second aspect of the invention is characterized in that the conductive high-refractive film in the cathode ray tube of the first aspect of the invention contains a mixture of particles of one or more noble metals, except for silver, or a mixture in which silver particles are mixed in with particles of another noble metal.

Because the electrical resistance of the conductive film may be lowered by employing the construction as described above, the leakage of electromagnetic waves may be fully suppressed and the anti-reflection and electric charge preventing functions may be fully achieved.

Further, according to a third aspect of the invention, the particles of noble metal in the color cathode ray tube in the second aspect of the invention are one of platinum, rhodium, ruthenium, palladium, iridium and osmium.

Because the electrical resistance of the conductive film may be lowered by employing the construction as described above, the leakage of electromagnetic waves may be fully suppressed and the anti-reflection and electric charge preventing functions may be fully achieved.

According to a fourth aspect of the invention, the low-refractive film in the color cathode ray tube in the first, second or third aspects of the invention has a light scattering characteristic.

Because the resistance of the conductive film may be lowered by employing the construction as described above, the leakage of electromagnetic waves may be fully suppressed, readily satisfying the international guideline of TCO, and the anti-reflection and electric charge preventing functions may be fully achieved.

Further, because the specific resistance of the above-mentioned noble metals, other than silver, is large, the thickness may be increased in order to provide a conductive film having a desired resistance. The transmittance of the conductive film decreases by thickening the film. Then, the overall transmittance is set at a desired value by using a panel whose transmittance is large, or more concretely, a panel using a glass ground whose absorption coefficient is 0.001 to 0.03 $mm^{-1}$ as provided in the cathode ray tube of a fifth aspect of the invention.

The transmittance of the faceplate may be arbitrarily set and a panel having a desired contrast may be constructed by selecting the thickness of the above-mentioned conductive film or the absorption coefficient of the panel glass. Further, the external reflection curve may be flattened by thickening the conductive film, and the coloring caused by the transmittance, which differs depending on wavelength of light and the reflection of the body color of the fluorescent substance, may be reduced, allowing a high image quality color cathode ray tube to be obtained.

The specific nature of the invention, as well as other objects, uses and advantages thereof, will clearly appear from the following description and from the accompanying drawings in which like numerals refer to like parts.

BRIEF DESCRIPTION OF DRAWINGS

FIG. 18 is a table for explaining the transmittance of various glass materials, which make up the panel, the transmittance of the treatment film formed thereon and the total transmittance of the treatment film and the glass; and FIG. 19 is a table for explaining the transmittance of a prior art color cathode ray tube.

DESCRIPTION OF PREFERRED EMBODIMENTS

Figure 1:
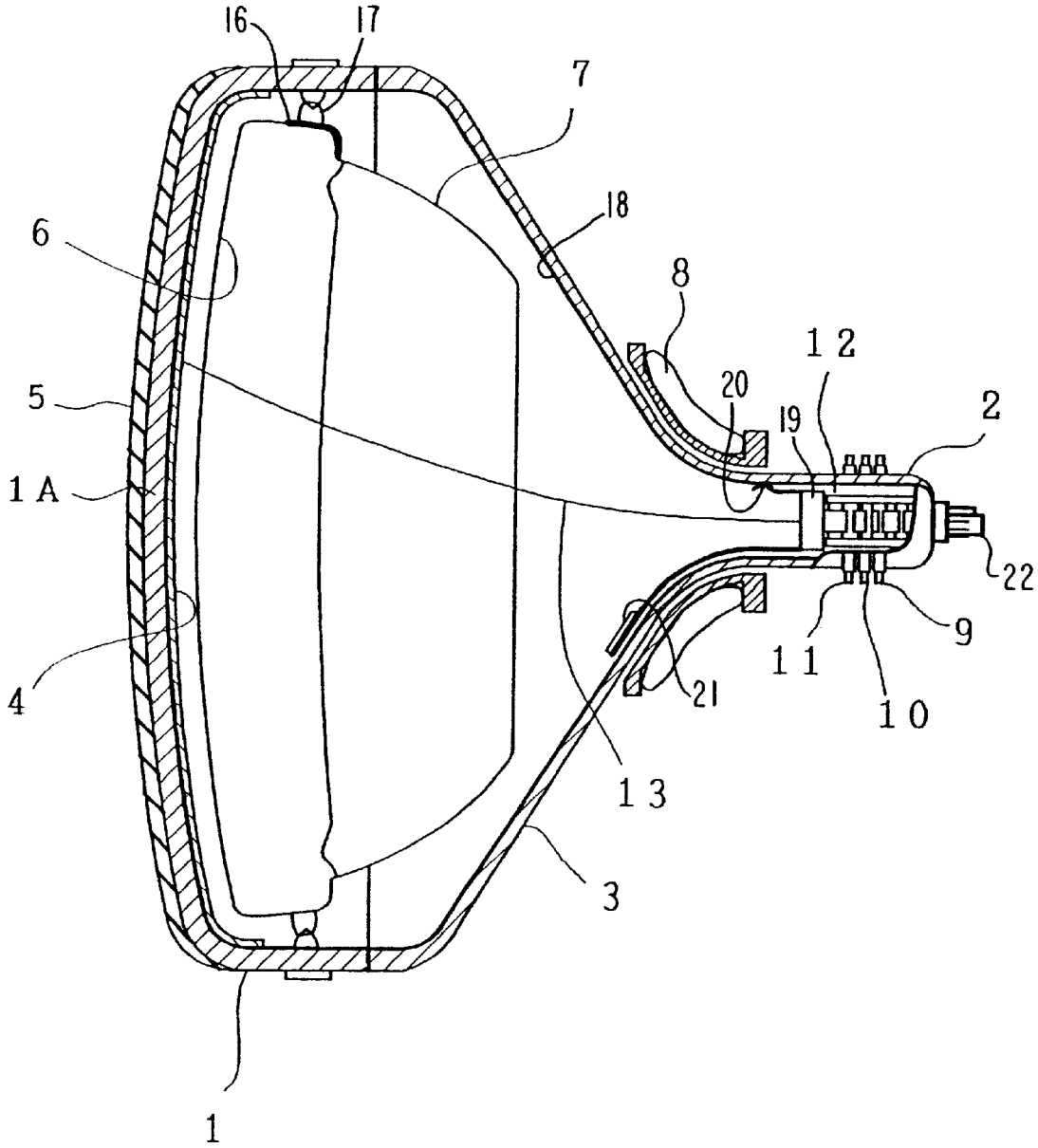
FIG. 1 is a sectional view showing a preferred embodiment of a cathode ray tube having a field leak preventing coating film in accordance with the present invention.

According to the present invention, a cathode ray tube has a field leakage preventing coating in the form of a double coating film, composed of a conductive high-refractive first layer, whose main component is metal particles, and a low-refractive second layer, whose main component is silicon oxide ($SiO_2$) or magnesium fluoride ($MgF_2$), adhered on the outer face of a faceplate of a panel section of the tube envelope, and one or more metals among the noble metal elements of gold (Au), silver (Ag) and platinum (Pt) are used as the metal particles in the conductive high-refractive first layer.

According to one aspect of the present invention, the conductive high-refractive first layer of the double coating film is arranged so as to have a light absorbing characteristic and a light transmittance of from 50 to 90% in the visual range.

According to another aspect of the present invention, the low-refractive second layer of the above-mentioned double coating film is arranged so as to have a selective wavelength absorbing characteristic by adding a coloring material, such as a pigment or dye, thereto.

According to one preferred embodiment of the present invention, the above-mentioned double coating film is formed by applying a solution, in which the metal particles for forming the conductive high-refractive first layer are dispersed, on the outer face of the faceplate of the panel section, by drying the applied surface to form the conductive high-refractive first layer, by applying an alcohol solution for forming the low-refractive second layer on the conductive high-refractive first layer and by sintering the applied surface in a temperature range of 160 to 175° C. to form the low-refractive second layer.

According to another preferred embodiment of the present invention, the above-mentioned double coating film is formed by applying a dispersed solution of metal particles for forming the conductive high-refractive first layer on the outer face of the faceplate of the panel section, by heating and drying the applied surface within a temperature range of 70 to 130° C. to adhere and form the conductive high-refractive first layer, by applying an alcohol solution for forming the low-refractive second layer on the conductive high-refractive first layer and by sintering the surface in a temperature range of 160 to 175° C. to form the low-refractive second layer.

According to the above-mentioned embodiment of the present invention, because particles of one or more kinds of metal, among the chemically stable noble metals of gold (Au), silver (Ag) and platinum (Pt), are used in the conductive high-refractive first layer of the double coating film, composed of the conductive high-refractive first layer mainly composed of the metal particles and the low-refractive second layer, provided on the outer face of the faceplate of the panel section of the cathode ray tube, the surface sheet resistance of the conductive high-refractive first layer may be reduced to as low as less than $1\times10^3$ Ω/□ and no deterioration of the surface sheet resistance of the conductive high-refractive first layer occurs for a long period of time.

According to another aspect of the present invention, the coloring matter, such as a pigment or dye, which is complementary in order to the coloring of the body of the cathode ray tube, is added to the low-refractive second layer, so that the coloring of the body of the cathode ray tube may be complemented so as to be turned to an achromatic color.

Various embodiments of the present invention will be explained below with reference to the drawings.

FIG. 1 is a section view for explaining an embodiment of the inventive color cathode ray tube, comprising a panel section 1, a faceplate 1A, a neck section 2, a funnel section 3, a fluorescent film 4, a double coating film 5, a shadow mask 6, an internal magnetic shield 7, a deflection yoke 8, a purity control magnet 9, a center beam static convergence control magnet 10, a side beam static convergence control magnet 11, an electron gun 12, an electron beam 13, a mask frame 16, a mask suspension mechanism 17, an internal conductive layer 18, a shield cup 19, a contact spring 20, a getter 21 and a stem pin 22.

That is, the color cathode ray tube comprises a vacuum envelope formed by the panel section 1, the neck section 2 and the funnel section 3, connecting the panel section 1 and the neck section 2, the fluorescent film 4 formed on the inner face of the panel section 1 and composed of three fluorescent substances, the electron gun 12 mounted within the neck section 2 and the deflecting yoke 8 sheathing the transition area of the funnel section 3 to the neck section 2. It is noted that the purity control magnet 9, the center beam static convergence control magnet 10 and the side beam static convergence control magnet 11 are disposed in parallel at the outside of the neck section 2.

The shadow mask, which is a color selection electrode fixed to the mask frame 16, is suspended and held to the inner wall of the skirt of the panel section 1 in close proximity to the fluorescent film 4 by the mask suspension mechanism 17 within the panel section 1. It is noted that the internal magnetic shield 7, which shields the electron beam 13 from the external magnetic field, is fixed to the mask frame 16. Three electron beams (only one beam is shown in FIG. 1) emitted from the electron gun 12 are deflected in a predetermined direction by the deflection yoke 8 and then impinge against the fluorescent film 4 vita an electron beam passing hole (not shown) of the shadow mask 6.

The internal conductive layer 18, such as a graphite film, is applied from the panel section 1 to the neck section 2 to supply an anodic voltage applied from an anode button (not shown) provided through the funnel section 3 to a conductive thin film (not shown) formed on the back of the fluorescent film 4 and to an anode electrode of the electron gun 12. This anodic voltage is supplied to the electron gun 12 via a contact spring 20 attached to the shield cup 19.

The double coating film 5, having functions for preventing reflection of external light, for preventing accumulation of an electric charge and for suppressing radiation of electromagnetic waves is formed on the faceplate 1A, which is the outer face of the screen of the panel section 1.

The double coating film 5 has a double-layered structure for purposes of enhancing the contrast of images, for preventing accumulation of an reflection of external light, for preventing electric charge and for suppressing radiation of electromagnetic waves.

Because the operation of the color cathode ray tube constructed as described above, i.e. the image displaying operation, is totally the same as the image displaying operation of a known color cathode ray tube, an explanation thereof will be omitted here.

[First Embodiment]

Figure 2:
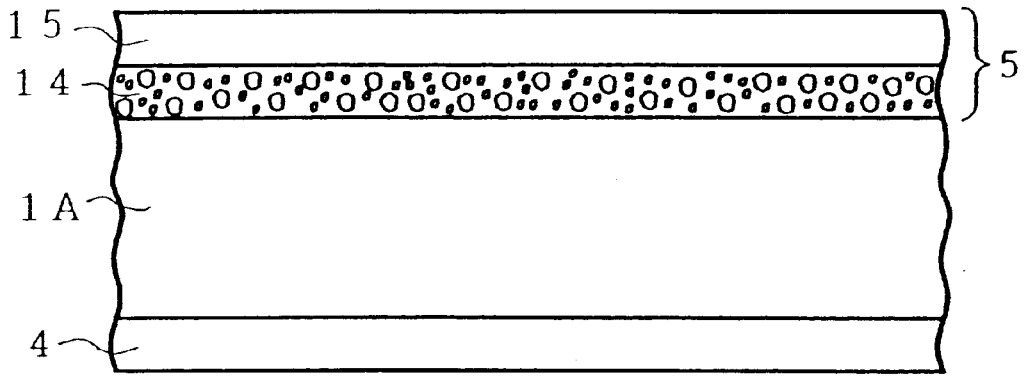
FIG. 2 is a sectional view showing part of a double coating film used for a cathode ray tube.

FIG. 2 is a sectional structural view showing a first embodiment of the double coating film 5 used in the color cathode ray tube of the present invention shown in FIG. 1. In FIG. 2, the double coating film 5 comprises a conductive high-refractive first layer 14 and a low-refractive second layer 15.

That is, the double coating film 5 comprises a conductive high-refractive first layer 14 whose main component is silver particles coated and formed on the faceplate 1A of the panel section 1 and a low-refractive second layer 15 made of silicon oxide ($SiO_2$) coated and formed on the conductive high-refractive first layer 14. The thickness of the conductive high-refractive first layer 14 is about 40 nm and that of the low-refractive second layer 15 is about 70 nm.

Figure 6:
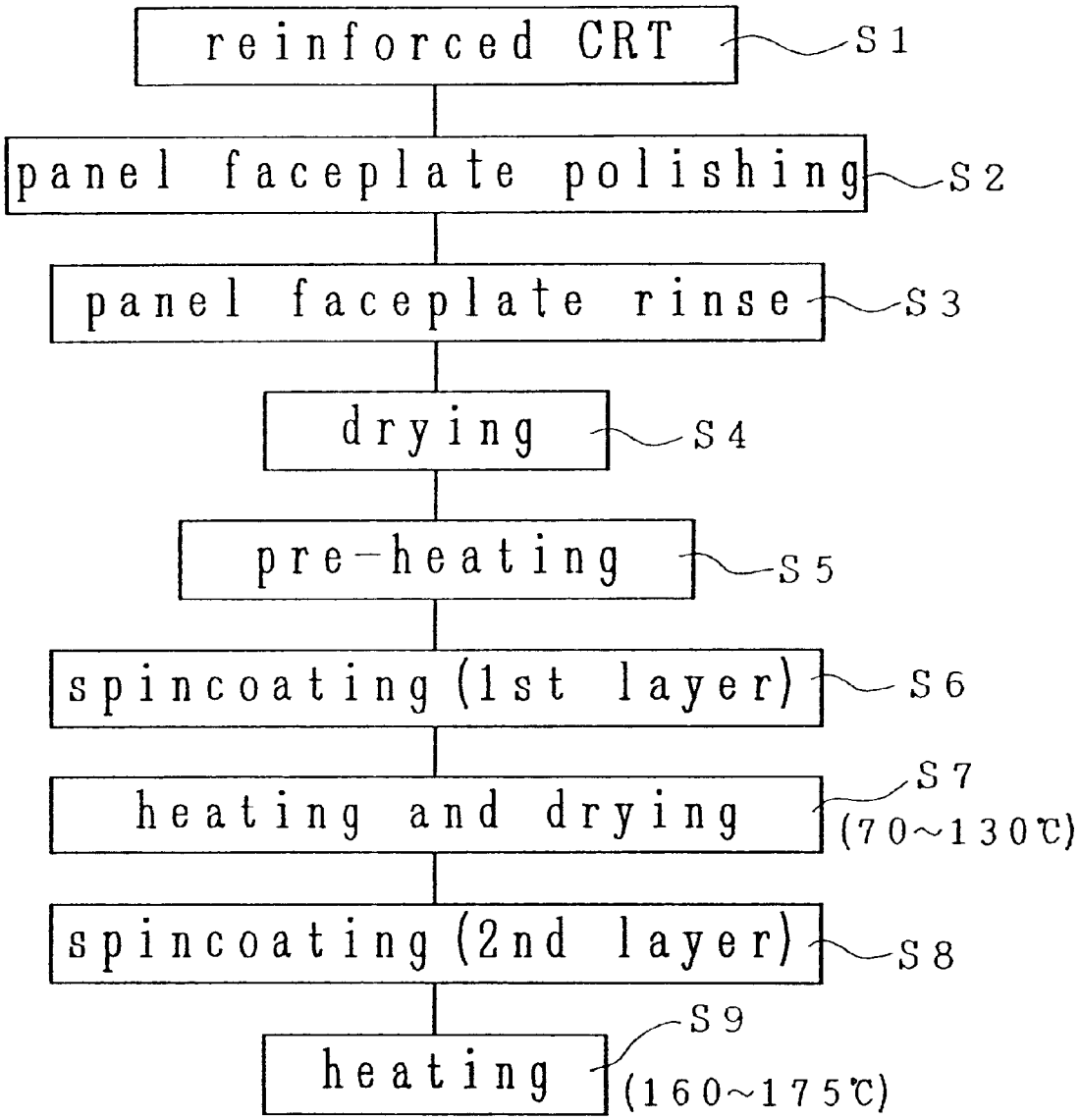
FIG. 6 is a flow chart showing steps for coating and forming the double coating film of FIG. 2 on a faceplate.

FIG. 6 is a flow chart showing a procedure for coating and forming the double coating film 5 of the present invention on the faceplate 1A. The steps for forming the double coating film 5 of the present invention will be explained by reference to the flow chart.

At first, a reinforcing fitting is attached around the panel section 1 of the color cathode ray tube in Step SI. Next, the surface of the faceplate 1A of the panel section 1 of the color cathode ray tube is polished using an abrasive in Step S2.

Then, the polished faceplate 1A is rinsed by showering it with city water or pure water in Step S3. The rinsed faceplate 1A of the panel section 1 is dried in Step S4.

Next, the temperature of the surface of the panel section 1 is set so as to be about 40° C. in Step S5.

Then, an aqueous dispersed solution (metal particle dispersed solution) composed of a high boiling point solvent having a solid component of silver (Ag) particles is spin-coated on the faceplate 1A of the panel section 1 to form the conductive high-refractive first layer 14 in Step S6.

Next, the faceplate 1A is heated at a temperature of about 100° C. to dry the conductive high-refractive first layer 14 thus coated in Step S7.

Then, an alcohol solution of silicon alkoxide is spin-coated on the conductive high-refractive first layer 14 to form the low-refractive second layer 15 while setting the surface temperature of the panel section 1 at about 40° C. in Step S8.

Then, the double coating film 5 is completed on the faceplate 1A of the panel section 1 by sintering the low-refractive second layer 15 by heating the faceplate 1A at temperature of about 165° C. in Step S9.

Figure 10:
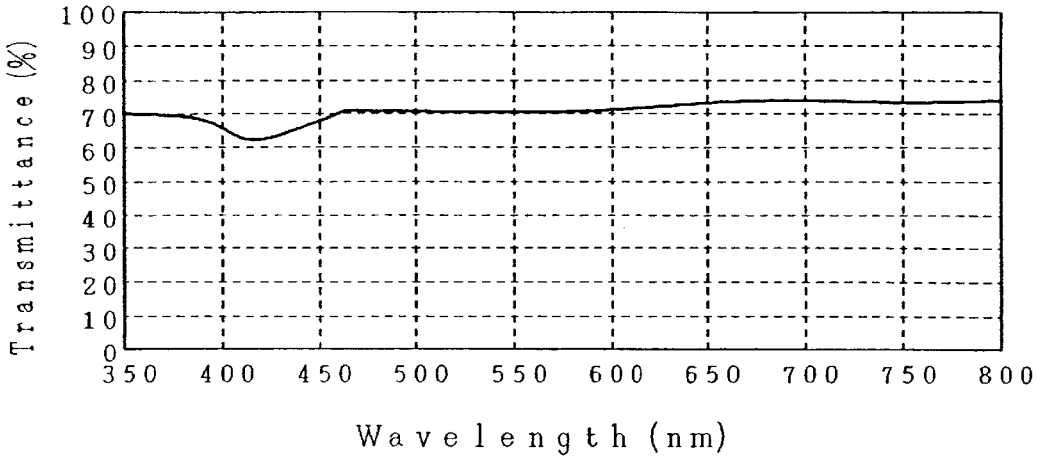
FIG. 10 is a characteristic chart showing a spectral transmittance of the color cathode ray tube having the double coating film of FIG. 2.

FIG. 10 is a characteristic diagram showing the spectral transmittance of the color cathode ray tube having the double coating film 5 of the present embodiment, obtained through the fabrication steps described above, wherein the vertical axis represents the light transmittance shown as a % and the horizontal axis represents the wavelength of light in nm.

As shown in FIG. 10, although the color cathode ray tube having the double coating film 5 of the present embodiment exhibits a slight light absorptivity in the vicinity of 420 nm of light wavelength, it is almost flat in the visual range. When the light transmission color of the color cathode ray tube having the double coating film 5 of the present embodiment is represented in accordance with a "Method for Displaying Color of Object by L'a'b' Color Specification System and L'a'v' Color Specification System" as described in JIS C8729, a'=−2 to +2 and b'=0 to +4 and the appearance of the faceplate 1A of the panel section 1 has been evaluated to have what is close to an achromatic color to the naked eye. Further, the color cathode ray tube having the double coating film 5 of the present embodiment has a surface sheet resistance of about 500 Ω/□, a leakage field strength of 0.5 V/m in the ELEF (frequency band of 5 Hz to 2 KHz) and of 0.5 V/m in the VLEF (frequency band of 2 KHz to 400 KHz) and fully satisfies the TCO Standard which is most rigorous for leakage field strength.

In addition, the color cathode ray tube having the double coating film 5 of the present embodiment has a visual reflectance of 0.7% and a light transmittance in the visual range of 72% and cancels the black color of the body of the color cathode ray tube, caused by the anti-reflection effect, so as to prevent it from standing out.

[Second Embodiment]

Figure 3:
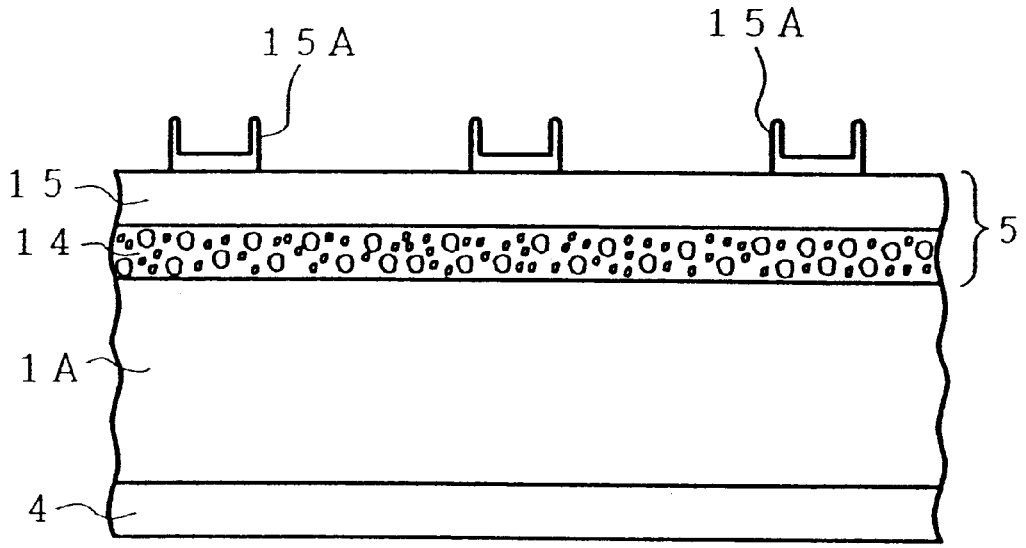
FIG. 3 is a sectional view showing part of a double coating film used for a cathode ray tube.

FIG. 3 is a sectional view showing a second embodiment of the double coating film 5 of the color cathode ray tube shown in FIG. 1. In FIG. 3, while there is shown a low refractive third layer 15A, the same components as those shown in FIG. 2 are denoted by the same reference numerals.

In this case, the double coating film 5 comprises a conductive high-refractive first layer 14 whose main component is silver particles coated and formed on the faceplate 1A of the panel section 1, a low-refractive second layer 15 made of silicon oxide ($SiO_2$) coated and formed on the conductive high-refractive first layer 14 and a low-refractive third layer 15A made of silicon oxide ($SiO_2$) formed partially on the low-refractive second layer 15, so as to produce an irregular surface. The thickness of the conductive high-refractive first layer 14 is about 40 nm, the thickness of the low-refractive second layer 15 is about 70 nm and the thickness of the low-refractive third layer 15A is about 10 nm at the thickest part.

The irregular low-refractive third layer 15A provided in the color cathode ray tube having the double coating film 5 of the present invention in this embodiment scatters external light slightly, making it possible to reduce mirror reflection which cannot be fully reduced otherwise when using only the antireflection effect of the double coating film 5.

Figure 7:
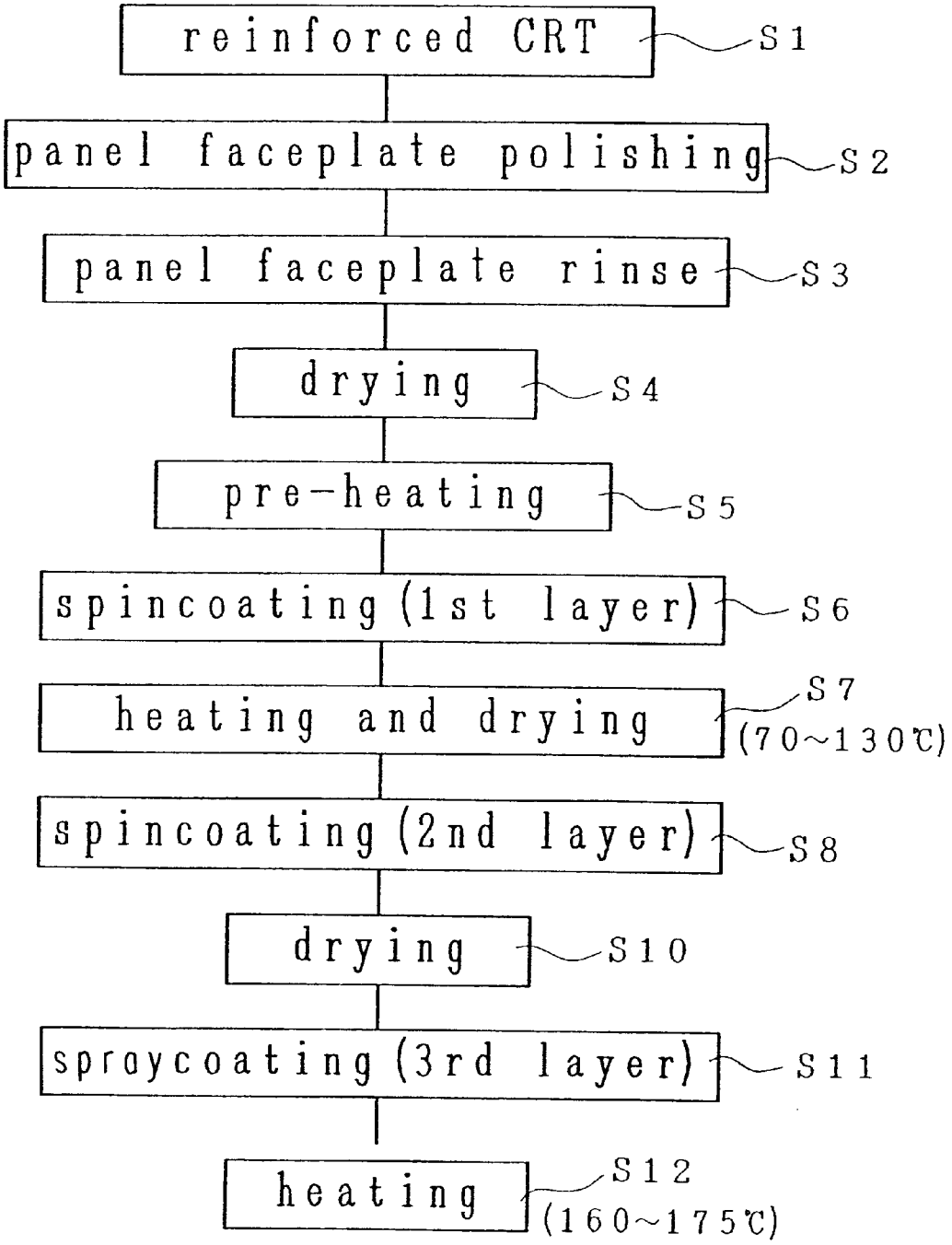
FIG. 7 is a flow chart showing steps for coating and forming the double coating film of FIG. 3 on a faceplate.

FIG. 7 is a flow chart showing a procedure for coating and forming the double coating film 5 of the first embodiment on the faceplate 1A. The procedure for forming the double coating film 5 of the present embodiment will be explained below by reference to the flow chart.

Steps S1 through S8 are the same as those in the procedure for forming the double coating film 5 described in FIG. 6 relating to the first embodiment.

Then, the faceplate 1A is heated at temperature of about 60° C. to dry the low-refractive second layer 15 in Step S10.

Next, an alcohol solution of silicon alkoxide whose composition is different from the alcohol solution used in step S8, is spray-coated partially on the low-refractive second layer 15 to form the low-refractive third layer 15A, while setting the temperature of the panel section 1 at about 50° C. in Step S11.

Then, the double coating film 5 is completed on the faceplate 1A of the panel section 1 by sintering the low-refractive third layer 15 and the low-refractive third layer 15A, respectively, by heating the faceplate 1A at temperature of about 165° C. in Step S12.

The spectral transmittance of the color cathode ray tube having the double coating film 5 of the present embodiment is almost the same as that of the color cathode ray tube having the double coating film 5 of the first embodiment, as shown in FIG. 10. Further, the light transmission color of the color cathode ray tube having the double coating film 5 of the present embodiment is a'=−2 to +2 and b'=0 to +4, which is almost the same as that of the color cathode ray tube having the double coating film 5 of the first embodiment. The appearance of the faceplate lA of the panel section 1 has been evaluated also as having what is close to an achromatic color to the naked eye. Still more, the color cathode ray tube having the double coating film 5 of the present embodiment has a surface sheet resistance of about 200 Q/□, a leaked field strength of 0.4 V/m in the ELEF and of 0.6 V/m in the VLEF and fully satisfies the TCO Standard.

In addition, the color cathode ray tube having the double coating film 5 of the present embodiment has a visual reflectance of 0.8% and a light transmittance in the visual range of 60% and cancels black color of the body color of the cathode ray tube, caused by the anti-reflection effect, so as to prevent it from standing out.

[Third Embodiment]

Figure 4:
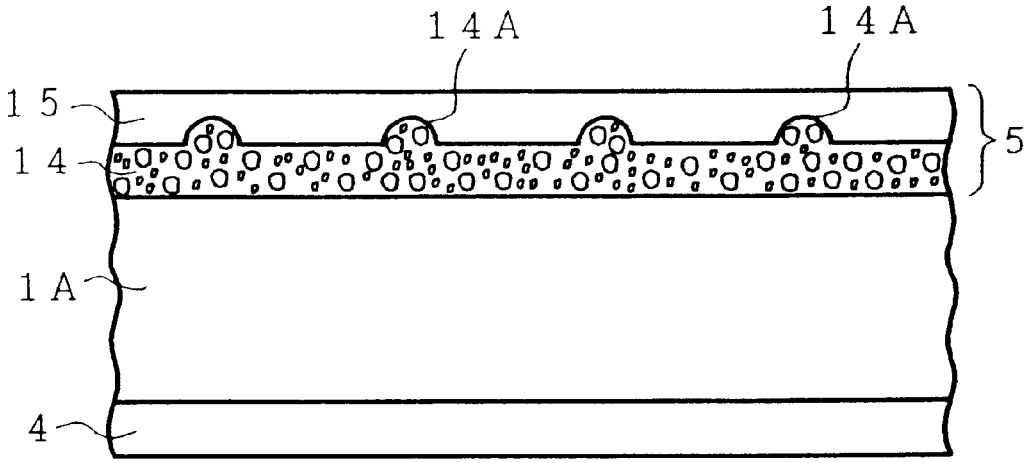
FIG. 4 is a sectional view showing part of a double coating film used for a cathode ray tube.

FIG. 4 is a sectional view showing a third embodiment of the double coating film 5 of the color cathode ray tube shown in FIG. 1. In FIG. 4, while convex portions 14A are provided on the conductive high-refractive first layer 14*a*, the same components as those shown in FIGS. 1 and 2 are denoted by the same reference numerals.

In the present embodiment, the double coating film 5 comprises a conductive high-refractive first layer 14, whose main component is silver particles coated and formed on the faceplate 1A of the panel section 1 and which has the convex portions 14A, and a low-refractive second layer 15 made of silicon oxide ($SiO_2$) coated and formed on the conductive high-refractive first layer 14 containing the convex portions 14A. The thickness of the conductive high-refractive first layer 14 at the flat part thereof is about 30 nm, the thickness of the convex portion 14A itself is about 15 nm at the thickest part and the thickness of the low-refractive second layer 15 is about 70 nm.

The convex portions 14A provided on the conductive high-refractive first layer 14 in the color cathode ray tube having the double coating film 5 of the first embodiment scatter external light slightly, making it possible to reduce mirror reflection which cannot be otherwise fully reduced only by the anti-reflection effect of the double coating film 5 above, similar to the color cathode ray tube having the double coating film 5 of the second embodiment.

Figure 8:
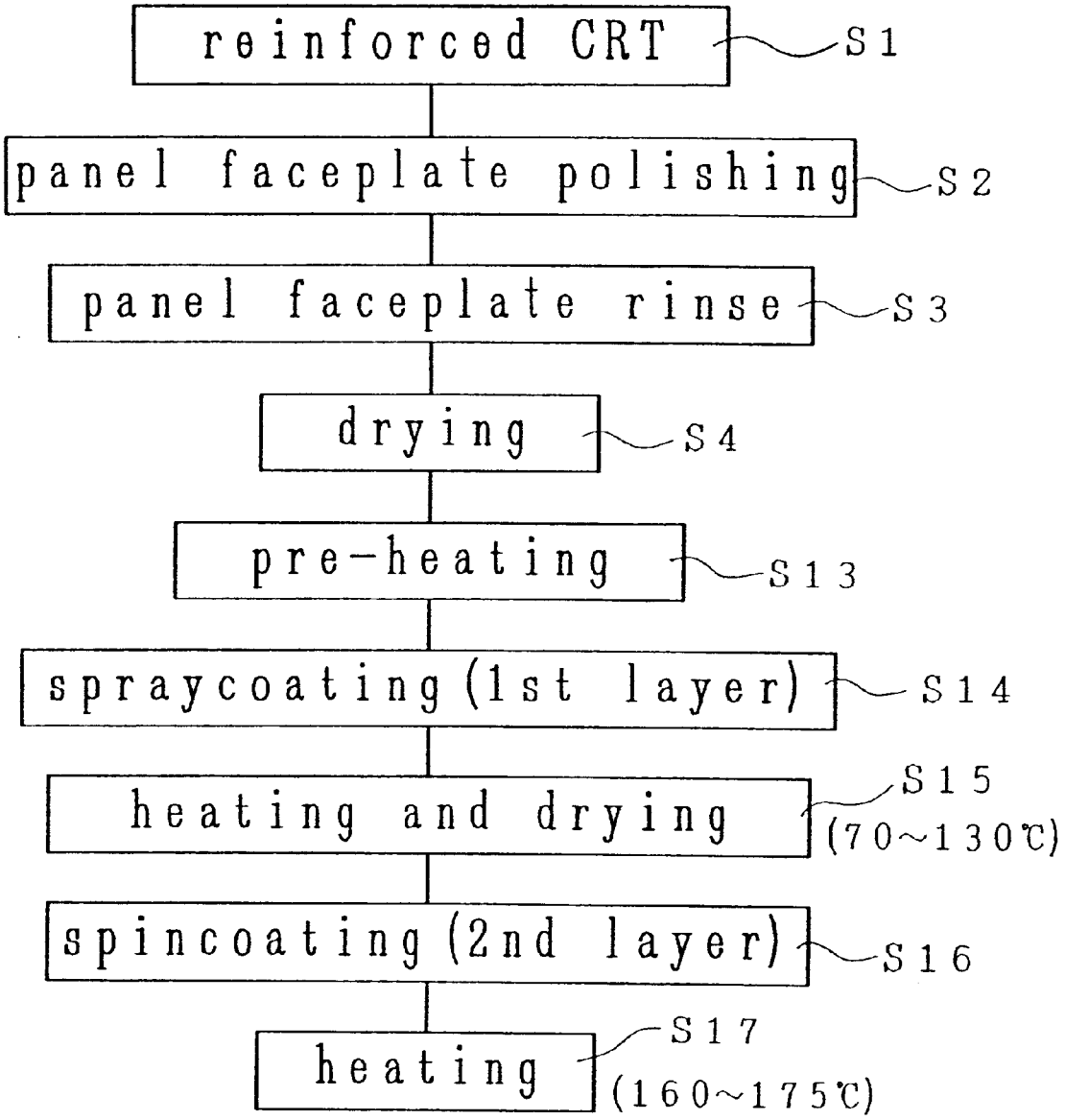
FIG. 8 is a flow chart showing steps for coating and forming the double coating film of FIG. 4 on a faceplate.

FIG. 8 is a flow chart showing a procedure for coating and forming the double coating film 5 of the present embodiment on the faceplate 1A. The procedure for forming the double coating film 5 of the present embodiment will be explained below by reference to the flow chart.

Steps S1 through S4 are the same as those in the procedure for forming the double coating film 5 described in the first embodiment.

Then, the temperature of the surface of the panel section 1 is set so as to be about 55° C. in Step S13.

Next, an aqueous dispersed solution (metal particle dispersed solution) composed of a high boiling point solvent containing a solid component of silver (Ag) particles is spray-coated on the faceplate 1A of the panel section 1 to form the conductive high-refractive first layer 14 partially having the convex portions 14A in Step S14.

Then, the faceplate 1A is heated at a temperature of about 75° C. to dry the conductive high-refractive first layer 14 having the convex portions 14A in Step S16.

Next, an alcohol solution of silicon alkoxide is spin-coated partially onto the conductive high-refractive first layer 14 having the convex portions 14A to form the low-refractive second layer 15, while setting the temperature of the panel section 1 at about 40° C. in Step S16.

Then, the double coating film 5 is completed on the faceplate 1A of the panel section 1 by sintering the low-refractive second layer 15 by heating the faceplate 1A at temperature of about 165° C. in Step S17.

The spectral transmittance of the color cathode ray tube having the double coating film 5 of the present embodiment is almost the same as that of the color cathode ray tube having the double coating film 5 of the first embodiment, as shown in FIG. 10. Further, the light transmission color of the color cathode ray tube having the double coating film 5 of the present embodiment is a'=−1 to +1 and b'=−1 to +1, which is almost the same as that of the color cathode ray tube having the double coating film 5 of the second embodiment.

The appearance of the faceplate 1A of the panel section 1 is close to an achromatic color, as seen by the naked eye. Still more, the color cathode ray tube having the double coating film 5 of the present embodiment has a surface sheet resistance of about 800 Q/□, a leakage field strength of 0.8 V/m in the ELEF and of 0.8 V/m in the VLEF, and fully satisfies the TCO Standard.

In addition, the color cathode ray tube having the double coating film 5 of the present embodiment has a visual reflectance of 0.8% and a light transmittance in the visual range of 65%, and cancels the black color of the body of the color cathode ray tube, caused by the anti-reflection effect, to prevent it from standing out.

[Fourth Embodiment]

Figure 5:
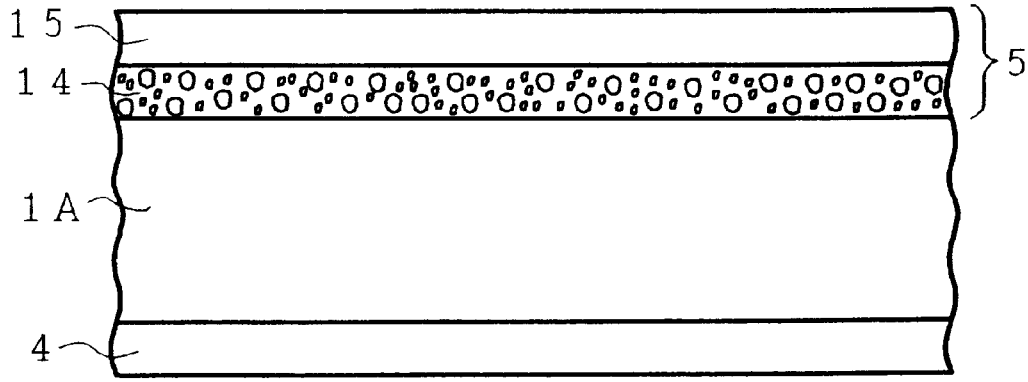
FIG. 5 is a sectional view showing part of a double coating film used for a cathode ray tube.

FIG. 5 is a sectional view showing a fourth embodiment of the double coating film 5 of the color cathode ray tube shown in FIG. 1. In FIG. 5, the same components with those shown in FIG. 2 are denoted by the same reference numerals.

In the present embodiment, the double coating film 5 comprises a conductive high-refractive first layer 14 whose main component is silver particles coated and formed on the faceplate 1A of the panel section 1 and a low-refractive second layer 15 made of silicon oxide ($SiO_2$) coated and formed on the conductive high-refractive first layer 14. The thickness of the conductive high-refractive first layer 14 is about 40 nm and the thickness of the low-refractive second layer 15 is about 70 nm.

Figure 9:
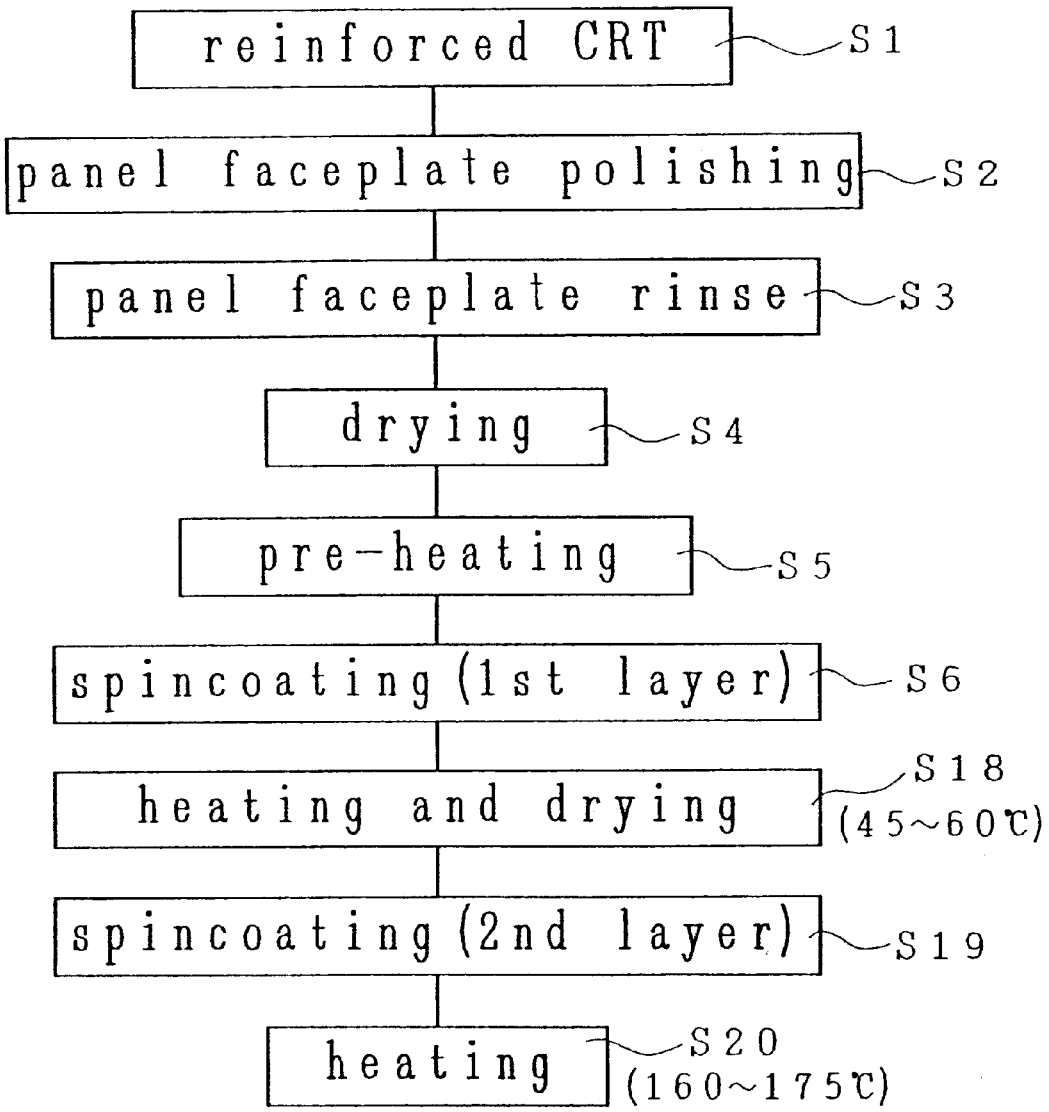
FIG. 9 is a flow chart showing steps for coating and forming the double coating film of FIG. 5 on a faceplate.

FIG. 9 is a flow chart showing a procedure for coating and forming the double coating film 5 of the present embodiment on the faceplate 1A. The procedure for forming the double coating film 5 on the color cathode ray tube of the present embodiment will be explained below by reference to the flow chart.

Steps S1 through S6 are the same as those in the procedure for forming the double coating film 5 described in the first embodiment.

Then, the faceplate 1A is heated at a temperature of about 50° C. to dry the conductive high-refractive first layer 14 in Step S18.

Next, an alcohol solution of silicon alkoxide is spin-coated on the conductive high-refractive first layer 14 to form the low-refractive second layer 15, while setting the temperature of the panel section 1 at about 40° C. in Step S19.

Then, the double coating film 5 of the present embodiment is completed on the faceplate 1A of the panel section 1 by sintering the low-refractive second layer 15 by heating the faceplate 1A at a temperature of about 165° C. in Step S20.

Figure 11:
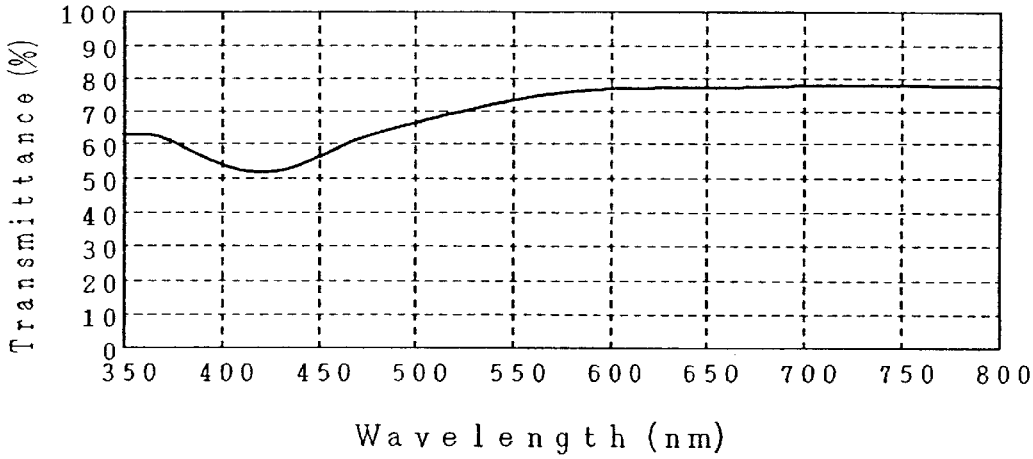
FIG. 11 is a characteristic chart showing a spectral transmittance of the color cathode ray tube having the double coating film of FIG. 5.

FIG. 11 is a characteristic diagram showing the spectral transmittance of the color cathode ray tube having the double coating film 5 of the present embodiment obtained through the fabrication steps described above, wherein the vertical axis represents the light transmittance shown as a % and the horizontal axis represents the wavelength of light in nm.

As shown in FIG. 11, although the color cathode ray tube having the double coating film 5 of the present embodiment shows light absorptivity in the vicinity of 420 nm of light wavelength, which is slightly larger than those of the color cathode ray tube having the double coating film 5 of the first through third embodiments, it is almost flat in the visual range. Further, the light transmission color of the color cathode ray tube having the double coating film 5 of the present embodiment is a'=−3 to +3 and b'=+8 to +15, which is almost the same as that of the color cathode ray tube having the double coating film 5 of the first through third embodiments, though the light transmission color b shows a value which is slightly greater than that of the light transmission color b' of the color cathode ray tube having the double coating film 5 of the first through third embodiments. The appearance of the faceplate 1A of the panel section 1 is evaluated to be colored slightly in amber, as seen by the naked eye. Still more, the color cathode ray tube having the double coating film 5 of the present embodiment has a surface sheet resistance of about 500 Q/□, a leaked field strength of 0.5 V/m in the ELEF and of 0.4 V/m in the VLEF, and fully satisfies the TCO Standard.

In addition, the color cathode ray tube of the present embodiment has a visual reflectance of 0.7% and a light transmittance in the visual range of 70%, and cancels the black of the body color of the color cathode ray tube, caused by the anti-reflection effect, to prevent it from standing out.

[Fifth Embodiment]

A double coating film 5 of a fifth embodiment may be obtained by dispersing a blue pigment, e.g. anthraquinone blue pigment, into the low-refractive second layer 15 of the double coating film 5 in the fourth embodiment. In the color cathode ray tube having the double coating film 5 of the present embodiment, the blue pigment, which is the complementary color of amber, is added to prevent the faceplate 1A of the color cathode ray tube having the double coating film 5 of the fourth embodiment from being amber in color.

The procedure for coating and forming the double coating film 5 of the present embodiment on the faceplate 1A is the same as the case of the color cathode ray tube of the fourth embodiment, as shown in FIG. 9, except for the fact that an alcohol solution in which the anthraquinone blue pigment of about 5 to 15% relative to the content of the solid component of silicon alkoxide is added in Step S19 in coating and forming the double coating film 5 in the present embodiment.

Figure 12:
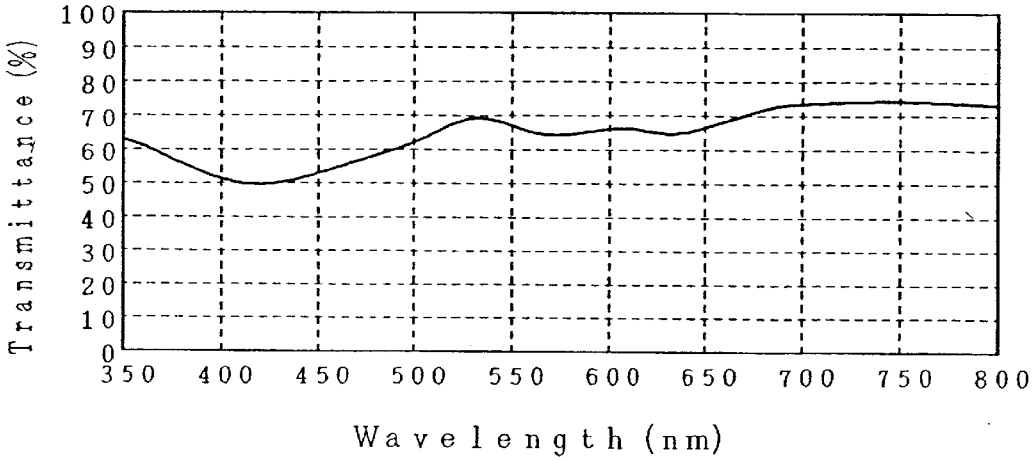
FIG. 12 is a characteristic chart showing a spectral transmittance of the color cathode ray tube having the double coating film of FIG. 5, including a blue pigment.

FIG. 12 is a characteristic chart showing the spectral transmittance of the color cathode ray tube of the present embodiment, wherein the vertical axis represents the light transmittance as a % and the horizontal axis represents the wavelength of light in nm. As shown in FIG. 12, in addition to the fact that the color cathode ray tube of the present embodiment exhibits a light absorptivity in the vicinity of 420 nm of light wavelength which is slightly larger than those of the color cathode ray tube of the first through third embodiments, similar to the color cathode ray tube of the fourth embodiment, the light absorptivity in the range from 520 nm of the visual range is slightly larger than that of the color cathode ray tube of the first through fourth embodiments. Further, the light transmission color of the present embodiment is a'=−4 to +2 and b'=+5 to +10, and the light transmission colors a' and b' have values smaller than those of the light transmission colors a' and b' of the color cathode ray tube of the fourth embodiment. The appearance of the faceplate lA of the panel section 1 is evaluated to be almost any achromatic color as seen by the naked eye. Still more, the color cathode ray tube of the present embodiment has a surface sheet resistance of about 300 Q/□, a leaked field strength of 0.4 V/m in the ELEF and of 0.4 v/m in the VLEF, and fully satisfies the TCO Standard.

In addition, the color cathode ray tube of the present embodiment has a visual reflectance of 0.6% and a light transmittance in the visual range of 68%, and cancels the black color of the body of the color cathode ray tube, caused by the anti-reflection effect, to prevent it from standing out.

It is noted that, although a case has been described in which silver (Ag) particles are mixed into the conductive high-refractive first layer 14 to form the double coating film 5 in the color cathode ray tube of the first through fifth embodiments, the present invention is not limited to the main component of the conductive high-refractive first layer 14 being formed of silver (Ag) particles and, in place of silver (Ag), particles of gold (Au), ruthenium (Ru), rhodium (Rh), palladium (Pd), osmium (Os), iridium (Ir), platinum (Pt) and the like or particles, into which two or more kinds of those noble metals are mixed may be used.

Further, although a case has been described in which the main component of the low-refractive second layer 15 is silicon dioxide ($SiO_2$) in the double coating film 5 of the color cathode ray tube of the first through fifth embodiments, the present invention is not limited to the low-refractive second layer 15 being mainly composed of silicon dioxide ($SiO_2$), and in place silicon dioxide ($SiO_2$), magnesium fluoride ($MgF_2$) may be used.

Further, in the procedure for forming the double coating film 5 on the faceplate 1A in the color cathode ray tube of the first through fifth embodiments, the temperature cited in each Step, i.e. the heating temperature in drying the conductive high-refractive first layer 14 in Steps S7 and S15, the temperature in drying the conductive high-refractive first layer 14 in Step S18, the sintering temperatures in Steps S9, S12, S17 and S20 are all only typical temperatures, and the present invention is not limited to those typical temperatures in forming the double coating film 5 on the faceplate 1A.

In the alternative, the heating temperature in drying the conductive high-refractive first layer 14 in Steps S7 and S15 may be any temperature between 70 and 130° C. as described in parenthesis in FIGS. 6 through 8, and the temperature in drying the conductive high-refractive first layer 14 in Step S18 may be any temperature between 45 and 60° C., as described in parenthesis in FIG. 9. Further, the sintering temperatures in Steps S9, S12, S17 and S20 may be any temperature between 160 and 175° C., as described in parenthesis in FIGS. 6 through 9.

In addition, although a case has been described wherein the pigment added to the low-refractive second layer 15 is the anthraquinone blue pigment in the fifth embodiment of the present invention, the present invention is not limited to the pigment being the anthraquinone blue pigment, and other pigments, such as dioxarine pigment, phthalocyanine pigment or dye or in addition to the dye and pigments, silane coupling material or the like may be added instead.

In each embodiment described above, the conductive high-refractive first layer 14, mainly composed of the metal particles, is formed by applying a solution in which the metal particles are dispersed on the faceplate lA and by drying the solution applied on the faceplate 1A in a drying step after controlling the temperature of the surface of the faceplate 1A by a pre-heating step. Then, the low-refractive second layer 15 is formed by applying an alcohol solution of silicon alkoxide. At this time, the alcohol solution of silicon alkoxide impregnates between the gaps of the metal particles of the conductive high-refractive first layer 14 and reaches the surface of the faceplate 1A. Then, in the following sintering step, silicon oxide (including silicon hydroxide), generated when the silicon alkoxide reacts, rigidifies the bonds between the conductive high-refractive first layer 14 and the metal particles, between the metal particles and the faceplate 1A and between the metal particles and the low-refractive second layer 15.

Accordingly, as the final configuration of the double coating film, the conductive high-refractive first layer 14 is composed of metal particles and silicon oxide as a binder, and the low-refractive second layer 15 is made of silicon oxide.

That is, while a layer composed of only metal particles is formed in the stage when the solution, in which the metal particles are dispersed, is applied, the conductive high-refractive first layer 14 composed of the metal particles and silicon oxide (including silicon hydroxide) is formed in the end (after sintering) as the alcohol solution impregnates, when the alcohol solution of silicon alkoxide is applied. The silicon oxide at this time functions as a binder and increases the closeness of the metal particles (increases the contact points), thus enhancing the electrical conductivity. It reduces the gaps among the metal particles and also fills the gaps, thus enhancing the refractivity of the conductive high-refractive first layer 14 further and improves the antireflection effect.

Because metal particles of more than one kind of the noble metal elements of gold (Au), silver (Ag) and platinum (Pt) which are chemically stable and are hardly oxidized, are used as the metal particles for the conductive high-refractive first layer 14 in the color cathode ray tube having the field leak preventing coating film of the present embodiment constructed as described above, the surface sheet resistance of the conductive high-refractive first layer 14 may be reduced to a low resistance of less than $1\times10^3$ Ω/□ and the surface sheet resistance of the conductive high-refractive first layer 14 will not degrade for a long period of time.

Further, because the coloring matter, such as the pigments or dyes which are complementary to the coloring of the body of the cathode ray tube, may be added to the low-refractive second layer 15 in the cathode ray tube having the field leakage preventing coating film of the present embodiment constructed as described above, the coloring of the body of the cathode ray tube may be complemented so as to be turned into an achromatic color.

[Sixth Embodiment]

The present embodiment will be explained by using FIG. 2. In FIG. 2, a surface treatment film 5, comprising a low resistant conductive high-refractive film 14 and a low-refractive film 15 made of silica or the like formed on the conductive high-refractive film 14, is shown. The same reference numerals with those in FIG. 1 correspond to the same components.

In the present embodiment, as the surface treatment film 5 formed on the outer face of the panel section 1 made of glass, the multi-layered structure of the low resistant conductive high-refractive film 14, which is formed on the faceplate 1A of the panel section 1 and in which silver and platinum particles are mixed in a ratio of 2:8, and the low-refractive film 15 formed by spin-coating silica on the conductive high-refractive film 14 is adopted. The light transmittance of visual range of the surface treatment film 5 having such structure is less than 70%.

[Seventh Embodiment]

The present embodiment will be explained by using FIG. 2. Each reference numeral in FIG. 2 designates the same element as those in the sixth embodiment. In the present embodiment, as the surface treatment film 5 formed on the outer face of the panel section 1 made of glass, a multi-layered structure of the low resistant conductive high-refractive film 14, which is formed on the faceplate 1A of the panel section 1 and in which silver and rhodium particles are mixed in a ratio of 1:9, and the low-refractive film 15, formed by spin-coating silica on the conductive high-refractive film 14, is adopted. The light transmittance in visual range of the surface treatment film 5 having such a structure is less than 70%, similar to the sixth embodiment.

[Eighth Embodiment]

The present embodiment will be explained by reference to FIG. 3. In FIG. 3, there are shown a low-refractive film 15A formed irregularly by spray-coating silica or the like on the low-refractive film 15 formed by spin-coating. The same reference numerals as those in FIG. 2 correspond the same parts or components. In the present embodiment, as the surface treatment film 5 formed on the outer face of the panel section 1 made of glass, a multi-layered structure of the low resistant conductive high-refractive film 14, which is formed on the faceplate 1A of the panel section 1 and in which silver and rhodium particles are mixed in a ratio of 1:9, the low-refractive film 15 formed by spin-coating silica on the conductive high-refractive film 14, and the low-refractive third layer 15A irregularly formed by spray-coating silica on the low-refractive film 15, is adopted.

Figure 13:
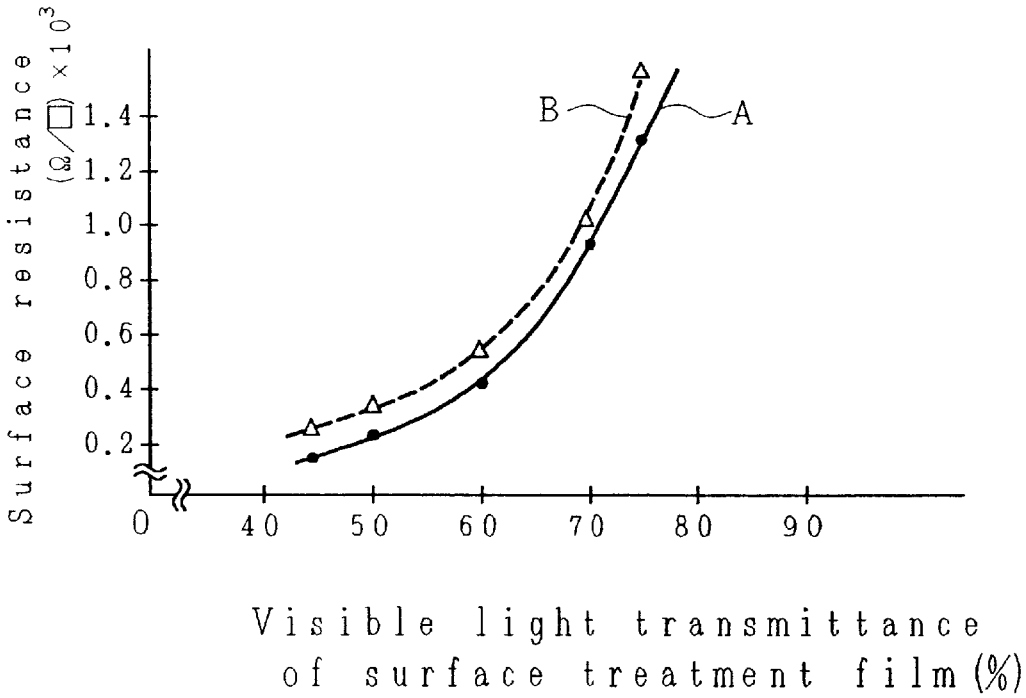
FIG. 13 is a graph showing a relationship between the transmittance of a surface treatment film in a visual range and a surface resistance thereof according to the present invention.

FIG. 13 is a graph showing a relationship between the light transmittance of the surface treatment film in the visual range and the surface resistance thereof according to the sixth embodiment and seventh embodiment of the present invention, wherein a curve A represents the characteristics of the low resistant conductive high-refractive film in which silver and platinum particles are mixed in the ratio of 2:8, and a curve B represents the characteristics of the low resistant conductive high-refractive film in which silver and rhodium particles are mixed in the ratio of 1:9.

It can be seen from the curves A and B in FIG. 13 that the surface resistance of the surface treatment film 5 is less than $1\times10^3$ Ω/□ when the light transmittance in the visual range is less than about 70%.

Using the surface treatment film 5, in which such a low resistant conductive high-refractive film 14 is formed below and a low-refractive film 15 is laminated thereon, allows the reflection of external light to be reduced, the accumulation of electric charge to be prevented and the leakage of electromagnetic waves to be remarkably reduced, and allows the international guideline (TCO) for restricting the radiation of electromagnetic waves to be readily satisfied.

It is noted that it has been found that the visual reflectance at this time (reflectance adapted to the characteristics of the human eye) is less than 1.2%.

Figure 14:
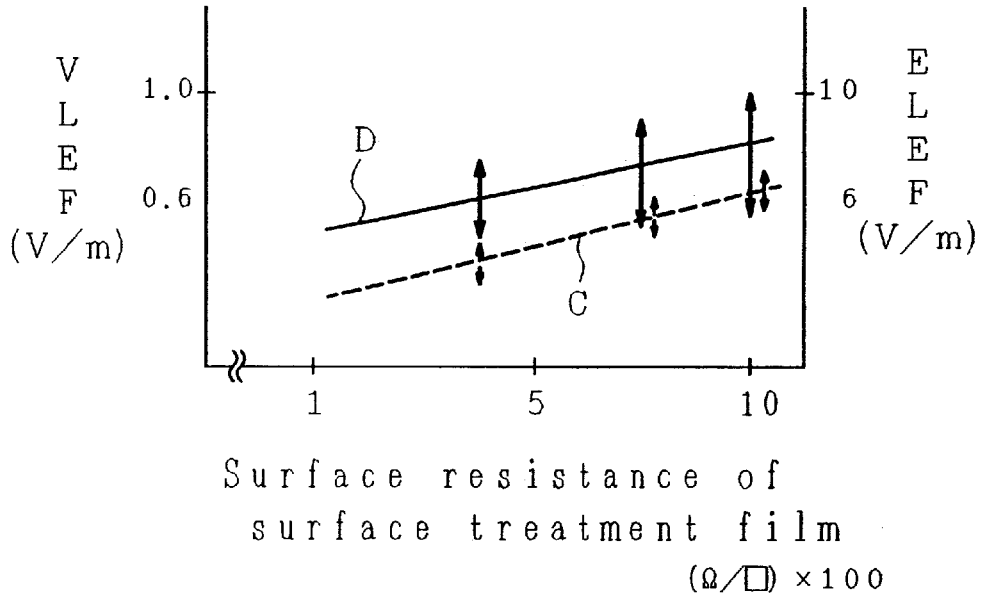
FIG. 14 is a graph showing a result of measurement of the surface resistance of the surface treatment film of a color cathode ray tube and the amount of leakage of electromagnetic waves.

FIG. 14 is a graph showing a result of measurement of the surface resistance of the surface treatment film having a low resistant conductive high-refractive film provided on the color cathode ray tube according to the invention and an amount of leakage of electromagnetic waves.

This measurement result shows a field strength at a distance of 30 cm from the panel face, when the color cathode ray tube, in which the surface treatment film of the sixth through eighth embodiments is employed, is assembled in a set, and the low resistant conductive high-refractive film is connected to ground. In FIG. 14, the straight line C represents the field strength ELEF (V/m) whose frequency is 5 Hz to 2 KHz and below, and the straight line D represents the field strength VLEF (V/m) whose frequency is 2 Hz to 400 KHz.

As shown in FIG. 14, using the low resistant conductive high-refractive film of the sixth through eighth embodiments as the surface treatment film formed on the outer face of the panel of the color cathode ray tube allows the degree of leaked electromagnetic waves to be reduced to a level which is far below the Swedish standard TCO of ELEF 10 V/m and VLEF: 1 V/m, the international guideline.

Figures 15, 16, 17:
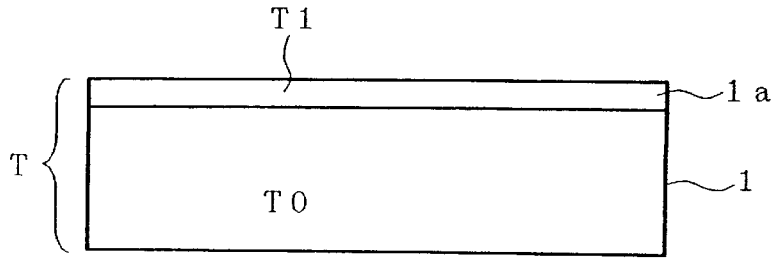
FIG. 15 is a table for explaining the electromagnetic wave leakage preventing effect of the surface treatment film of the color cathode ray tube of the present invention as compared numerically with an international guideline (TCO of Sweden)
FIG. 16 is a table for explaining the cost for forming the surface treatment film of the color cathode ray tube of the present invention as compared to a cost for forming a sputtering film and a NESA coat.
FIG. 17 is a schematic section view of a panel for explaining the transmittance of the panel of a color cathode ray tube.

FIG. 15 is a table for explaining the electromagnetic wave leakage preventing effect of the surface treatment film of the sixth, and seventh embodiments as compared numerically with the international guideline (TCO of Sweden).

In FIG. 15, it can be seen that the electromagnetic wave leakage preventing effects of the sixth and seventh embodiments are both less than 10 (ELEF) or 1 V/m (VLEF), the guideline. Particularly, both the ELEF and VLEF of the sixth embodiment are less than half of the guideline, showing that the sixth embodiment has a quite large effect for shielding the electromagnetic waves.

Next, a method for forming the surface treatment film provided in the color cathode ray tube of the sixth through eighth embodiments of the present invention will be explained.

[First Example of a Method for Forming a Treatment Film]

After manufacturing a color display tube having an effective diagonal length of 51 cm and an average transmittance in the visual range of the panel of 76% by the conventional cathode ray tube manufacturing method, a first layer was formed by cleaning the surface of the panel using an abrasive and the like, a solution having the following "Composition 1" was injected and was shaken off for 60 seconds with a number of rotations at 180 rpm so as to have a thickness of less than 0.1 μm, while holding the outer face of the panel upward and keeping the surface temperature at 50° C.

It was heated again to dry. Then, a second layer was formed by injecting 50 ml of solution having the following "Composition 2" on the above-mentioned first layer while keeping the temperature of the surface of the panel at 50° C., similar to one described above, by shaking it off for 50 seconds with a number of rotations at 175 rpm and by heating it for 30 minutes at 170° C.

As a result, a chemically stable and mechanically strong surface treatment film, having a surface resistance of $2\times10^2$ Ω/□, an average transmittance in the visual range of 58% and a visual reflectance of 1.2% was obtained. "Composition 1"

silver and platinum (Ag/Pt=2/8) particle dispersed solution particles . . . 1.1 wt %
ethyl alcohol . . . 6 wt %
dispersant . . . 0.01 wt %
pure water . . . remainder "Composition 2"

organic silane alcohol solution
ethoxysillane . . . 0.08 wt %
hydrochloric acid . . . 0.001 wt %
methyl alcohol . . . remainder

[Second Example of a Method for Forming a Treatment Film]

The color display tube having an effective diagonal length of 51 cm was manufactured similar to the abovementioned first example and a first layer was formed after cleaning the surface of the panel by injecting a solution having the following "Composition 3" and by shaking it off for 60 seconds with a number of rotations at 180 rpm so as to have a thickness of less than 0.1 μm while keeping the surface temperature at 50° C.

It was dried and a second layer was formed by injecting 50 ml of a solution having the "Composition 2" similar to the first example, while keeping the temperature of the surface at 50° C., by shaking it off for 50 seconds with a number of rotations at 170 rpm and by heating it for 30 minutes at 170° C.

As a result, a chemically stable and mechanically strong surface treatment film, having a surface resistance of $1\times10^3$ Ω/□, an average transmittance of visual range of 70% and a visual reflectance of 0.8%, was obtained.

"Composition 3"

silver and rhodium (Ag/Rh=1/9) particle dispersed solution particles . . . 0.9 wt % isopropyl alcohol . . . 10 wt % dispersant . . . 0.005 wt % pure water . . . remainder

[Third Example of a Method for Forming a Treatment Film]

After forming the double coating film by the same method as the above-mentioned second example of the method for forming the treatment film, the surface of the panel was heated up to 60° C. and a solution having the following "Composition 4" was sprayed on the whole panel by using a two-fluid nozzle spray gun. It was carried out by scanning the whole surface once under the conditions 47 of 1.8 1/h of flow rate of the solution having the "Composition 4", 180 1/min. of air flow rate, 30° of spraying angle to the surface of the panel, 30 cm of distance from the spray gun to the surface of the panel and a 500 mm/min sweep speed.

The film formed by the spray was heated for 30 minutes at 170° C. As a result, a chemically stable and mechanically strong surface treatment film, having a surface resistance of $1\times10^3$ Ω/□, an average transmittance in the visual range of 70% and a visual reflectance of 0.9%, and having an appearance similar to a low reflective evaporated film or sputtered film, was obtained.

"Composition 4"

Organic silane alcohol solution ethoxysillane . . . 1.7 wt % nitric acid . . . 0.5 wt % pure water . . . 8.0 wt % ethyl alcohol . . . remainder

It is noted that, although the cases of using the particles in which platinum and rhodium or silver are mixed have been explained in the sixth through eighth embodiments and the methods for forming the treatment film of the first through third examples, the present invention is not limited only to those cases and a sole substance of palladium, iridium, osmium and the like, or a mixture of two or more of those substances, or particles in which palladium, iridium, osmium and the like is mixed with silver, may be used.

Because the electrical resistance as such noble metals of palladium, iridium and osmium are all within a range of $10^{-5}$ to $10^{-6}$ Q·cm, which is several to ten-odd times that of silver, the mixing ratio may be decided corresponding to the resistance obtained when they are mixed with silver. However, it is preferable to set the mixing ratio of silver to be about 10% in view of the practical stability.

According to the sixth through eighth embodiments of the present invention, as described above, the cost for forming the treatment film on the outer face of the panel may be lowered considerably as compared to that of the sputtering or the NESA coat forming method.

FIG. 16 is a table for explaining the cost for forming the surface treatment film of the sixth through eighth embodiments of the present invention as compared to the cost for forming the sputtered film and a NESA coat. As shown in this table, when the cost is assumed to be 100 in forming the sputtered film, the cost of the NESA coat is 50 and that of the low resistant conductive high-refractive film of the sixth through eighth embodiments of the present invention is 25. That is, the high performance surface treatment film may be obtained at low cost.

Next, the transmittance of the color cathode ray tube of the sixth through eighth embodiments of the present invention will be explained by comparison thereof with that of the prior art color cathode ray tube.

FIG. 17 is a schematic section view of a panel for explaining a transmittance of the panel of the color cathode ray tube, comprising the panel section 1 made of glass and treatment film 1*a* formed on the outer face thereof.

Here, when the transmittance of the glass of the panel section 1 is designated $T_0$ and a transmittance of the treatment film is designated $T_1$, the transmittance of the whole panel forming the treatment film (total transmittance) may be expressed as $T=T_0\times T_1$. Here, the transmittance T of the whole panel having the treatment film and the transmittance $T_0$ of the underlying panel may be measured by referencing air, and the transmittance $T_1$ of the treatment film is measured by the transmittance of the panel having the treatment film by referencing the underlying panel.

While each transmittance may be expressed by the following expressions and by an absorption coefficient, it will be explained below with the transmittance actually measured.

$$T_0o=(1-R_1)\times(1-R_1)\times EXP\ (-k_1\times t_1)$$

$$T=(1-R_1)\times(1-R_2)\times EXP\ (-k_1\times t_1)\times EXP\ (-k_2\times t_2)$$

$$T1=(1-R_1)\times(1-R_2)\times EXP\ (-k_1\times t_1)\times EXP\ (-k_2\times t_2)/(1-R_1)\times(1-R_2)\times EXP\ (-k_1\times t_1)$$

where, $T_0$ is transmittance of underlying panel,

T is transmittance of panel attached with treatment film, $T_1$ is transmittance of treatment film, $R_1$ is reflectance of the panel glass, $R_2$ is reflectance of the surface treatment film, $k_1$ is absorption coefficient ($mm^{-1}$) of the panel glass, $k_2$ is absorption coefficient ($mm^{-1}$) of the surface treatment film, $t_1$ is a thickness of the panel glass, and $t_2$ is a thickness of the surface treatment film.

FIG. 18 is a table for explaining the transmittance of various glass materials for composing the panel, the transmittance of only the treatment film formed thereon and the transmittance (total transmittance) of the treatment film and the glass in total.

The transmittance of the panel when its absorption coefficient is 0.0058 $mm^{-1}$ and when it has a clear ground of 13 mm in thickness is 85% and the total transmittance when the treatment film having a transmittance of 50% is formed thereon turns out to be 43%.

The transmittance of the panel when its absorption coefficient is 0.0014 $mm^{-1}$ and when it has a semi-clear ground of 13 mm in thickness is 76% and the total transmittance when the treatment film having a transmittance of 50% is formed thereon turns out to be 38%. Further, when a treatment film having a transmittance of 60% is formed on the panel having a semiclear ground, the total transmittance turns out to be 46% and when a treatment film having a transmittance of 66% is formed similarly on the panel having a semi-clear ground, the total transmittance is 50%.

The transmittance of the panel when its absorption coefficient is 0.0022 $mm^{-1}$ and when it has a gray ground of 13 mm in thickness is 69% and the total transmittance when the treatment film having a transmittance of 62% is formed thereon turns out to be 43% and when a treatment film having a transmittance of 67% is formed on the panel having a gray ground, the total transmittance turns out to be 46%.

Meanwhile, the present color cathode ray tube uses a tinted panel or a dark tinted panel for the panel glass and a treatment film having a transmittance of 86 to 100% is formed on the outer face thereof.

FIG. 19 is a table for explaining the transmittance of a prior art color cathode ray tube of a high-contrast type. When the panel is made of tinted glass, the total transmittance turns out to be 43 to 46% when the transmittance of the tinted glass is 50% and a treatment film having a transmittance of 86 to 92% is formed on the tinted glass. When the panel is made of dark tinted glass, the total transmittance turns out to be 38% when the transmittance of the dark tinted glass is 38% and a treatment film having a transmittance of 100% is formed on the dark tinted glass.

While a total transmittance of 46% is the general standard of the prior art color cathode ray tube of this kind, the color cathode ray tube having a total transmittance of around 46% may be constructed by forming the above-mentioned inventive treatment film by using the clear panel, semi-clear panel or gray panel shown in FIG. 18.

Thus, the embodiments of the present invention provide a color cathode ray tube which prevents the reflection of external light and the accumulation of electric charge and reduces the leakage of electromagnetic waves considerably as compared to the international standard and can be obtained at low cost.

While preferred embodiments have been described, variations thereto will occur to those skilled in the art within the scope of the present inventive concepts which are delineated by the following claims.

What is claimed is:

1. A color cathode ray tube, comprising;

a vacuum envelope comprising a panel section, a neck section and a funnel section connecting said panel section and said neck section;

a fluorescent film applied on an inner face of said panel section; and an electron gun, mounted in said neck section, for emitting at least one electron beam toward said fluorescent film;

said color cathode ray tube further comprising:

a first layer, containing particles of silver (Ag) and other conductive particles, formed on an outer surface of said panel section; and a second layer having a lower refractive index than that of said first layer and over-coating said first layer, wherein said second layer has coloring matter incorporated therein, exerting a wavelength selective absorbing characteristics.

2. A color cathode ray tube, comprising:

a vacuum envelope comprising a panel section, a neck section and a funnel section connecting said panel section and said neck section;

a fluorescent film applied on an inner face of said panel section; and an electron gun, mounted in said neck section, for emitting at least one electron beam toward said fluorescent film;

said color cathode ray tube further comprising:

a first layer, containing particles of silver (Ag) and other conductive particles, formed on an outer surface of said panel section, wherein the weight percent of said silver particles is less than the weight percent of said other conductive particles; and a second layer having a lower refractive index than that of said first layer and over-coating said first layer.

* * * * *